US008977147B2

(12) United States Patent
Hirano

(10) Patent No.: US 8,977,147 B2
(45) Date of Patent: Mar. 10, 2015

(54) IMAGE FORMING APPARATUS CAPABLE OF COMPUTING POWER CONSUMPTION THEREOF, AND CONTROL METHOD AND STORAGE MEDIUM THEREFOR

(75) Inventor: Yasuhiko Hirano, Yokohama (JP)

(73) Assignee: Canon Kabushiki Kaisha (JP)

( * ) Notice: Subject to any disclaimer, the term of this patent is extended or adjusted under 35 U.S.C. 154(b) by 310 days.

(21) Appl. No.: 13/281,852

(22) Filed: Oct. 26, 2011

(65) Prior Publication Data

US 2012/0106995 A1 May 3, 2012

(30) Foreign Application Priority Data

Oct. 27, 2010 (JP) ..... 2010-240921

(51) Int. Cl.
*G03G 15/00* (2006.01)
*G03G 15/20* (2006.01)

(52) U.S. Cl.
CPC ..... *G03G 15/2078* (2013.01); *G03G 15/5029* (2013.01); *G03G 15/5004* (2013.01)
USPC ..... 399/45; 399/69; 399/88

(58) Field of Classification Search
CPC ..... G03G 15/5004; G03G 15/2078; G03G 15/5029
USPC ..... 399/45, 69, 88
See application file for complete search history.

(56) References Cited

U.S. PATENT DOCUMENTS

| | | | | |
|---|---|---|---|---|
| 4,992,829 | A * | 2/1991 | Sander et al. | 399/32 |
| 6,298,213 | B1 * | 10/2001 | Miyamoto et al. | 399/320 |
| 2004/0017434 | A1 | 1/2004 | Okayasu et al. | |
| 2005/0111892 | A1 * | 5/2005 | Mitsuoka et al. | 399/328 |
| 2007/0086798 | A1 * | 4/2007 | Nishi | 399/69 |
| 2009/0324265 | A1 | 12/2009 | Ito | |

FOREIGN PATENT DOCUMENTS

JP 2002-067445 A 3/2002

(Continued)

OTHER PUBLICATIONS

JP 2002078195 A English Translation to Morita (Mar. 2002).*

(Continued)

*Primary Examiner* — Ryan Walsh
(74) *Attorney, Agent, or Firm* — Rossi, Kimms & McDowell LLP

(57) ABSTRACT

An image forming apparatus capable of accurately computing power consumption thereof. First power consumption consumed by a fixing device of the image forming apparatus until the fixing device becomes a state capable of fixing a toner image onto a sheet is computed, second power consumption that includes power consumption consumed by the fixing device to fix the toner image onto the sheet and power consumption consumed by conveyance of the sheet is computed according to at least a sheet type, and third power consumption consumed by an exposure unit of the image forming apparatus to expose a photosensitive member of the image forming apparatus to light is computed according to an image to be formed. Then, a sum of the first to third power consumptions is computed.

9 Claims, 7 Drawing Sheets

(56) References Cited

FOREIGN PATENT DOCUMENTS

| | | | | |
|---|---|---|---|---|
| JP | 2002078195 | A | * | 3/2002 |
| JP | 2004-009410 | A | | 1/2004 |
| JP | 2004345220 | A | * | 12/2004 |
| JP | 2010-004382 | A | | 1/2010 |
| JP | 2010-008782 | A | | 1/2010 |
| JP | 2010-072253 | A | | 4/2010 |

OTHER PUBLICATIONS

JP 2004345220 A English Abstract to Matsumoto (Dec. 2004).*

Japanese Office Action for corresponding JP 2010-240921, mail date Jul. 8, 2014.

* cited by examiner

*FIG. 2*

| SHEET TYPE | FIXING-DEVICE POWER CONSUMPTION | SHEET CONVEYANCE POWER CONSUMPTION |
|---|---|---|
| A3 | PW_F A3_BW, PW_F A3_CL | PW_C A3 |
| B4 | PW_F B4_BW, PW_F B4_CL | PW_C B4 |
| A4 | PW_F A4_BW, PW_F A4_CL | PW_C A4 |
| B5 | PW_F B5_BW, PW_F B5_CL | PW_C B5 |
| LETTER | PW_F LTR_BW, PW_F LTR_CL | PW_C LTR |
| LEGAL | PW_F LGL_BW, PW_F LGL_CL | PW_C LGL |
| POSTCARD | PW_F PCD_BW, PW_F PCD_CL | PW_C PCD |

IMAGE FORMING APPARATUS CAPABLE OF COMPUTING POWER CONSUMPTION THEREOF, AND CONTROL METHOD AND STORAGE MEDIUM THEREFOR

BACKGROUND OF THE INVENTION

1. Field of the Invention

The present invention relates to an image forming apparatus capable of computing power consumption thereof, and a control method and a storage medium therefor.

2. Description of the Related Art

In recent years, image forming apparatuses such as printers have been demanded to reduce power consumption thereof for reduction of emission of greenhouse gas such as carbon dioxide. To this end, it is necessary to grasp power consumptions of individual image forming apparatuses at the time of image formation. However, if an externally-attached power meter or a built-in power meter is provided in each of individual image forming apparatuses, a problem of increased cost is caused.

Japanese Laid-open Patent Publication No. 2010-4382 discloses a power measurement system including an image forming apparatus with no power meter and an image forming apparatus with power meter, which are network-connected with each other. This system estimates power consumption of the image forming apparatus with no power meter which is consumed when the apparatus is in a sleep state on the basis of power consumption of the image forming apparatus with power meter measured by the power meter and consumed when the apparatus is in a sleep state.

With the power measurement system, power consumption of the image forming apparatus consumed when the apparatus is in a sleep state can be estimated, but power consumption thereof consumed when the apparatus executes a print job cannot accurately be computed.

Japanese Laid-open Patent Publication No. 2010-72253 discloses a power consumption calculation method in which a work load of a job executed by an image forming apparatus is measured and a power consumption amount corresponding to one job execution is calculated based on the measured work load and state transition data that indicates power consumption and a required time for each of states of the image forming apparatus.

Power consumption differs depending on print job contents. For example, power consumption differs between monochrome text printing on an A4 sheet and color graphic printing on a postcard due to a difference in fixing device temperature and a difference in sheet conveyance motor speed. Nevertheless, the above-described power consumption calculation method cannot compute power consumption that reflects factors affecting the power consumption.

As described above, conventional techniques have a problem that power consumption of image forming apparatus cannot be computed with accuracy.

SUMMARY OF THE INVENTION

The present invention provides an image forming apparatus capable of accurately computing power consumption thereof, and a control method and a storage medium therefor.

According to one aspect of this invention, there is provided an image forming apparatus having a photosensitive member, an exposure unit that exposes the photosensitive member to light according to an image to be formed to thereby form an electrostatic latent image on the photosensitive member, and a fixing device that fixes onto a recording medium a toner image formed on the photosensitive member by developing the electrostatic latent image and transferred from the photosensitive member to the recording medium, comprising a first computing unit configured to compute first power consumption consumed by the fixing device until the fixing device becomes a state capable of fixing the toner image onto the recording medium, a second computing unit configured to compute, according to at least a type of the recording medium, second power consumption that includes power consumption consumed by the fixing device to fix the toner image onto the recording medium and power consumption consumed to convey the recording medium onto which the toner image is to be fixed, a third computing unit configured to compute, according to the image to be formed, third power consumption consumed by the exposure unit to expose the photosensitive member to light, and a fourth computing unit configured to compute a sum of the first power consumption, the second power consumption, and the third power consumption.

With this invention, the first power consumption consumed by the fixing device of the image forming apparatus until the fixing device becomes capable of fixing a toner image onto a recording medium is computed, the second power consumption that includes power consumption consumed by the fixing device to fix the toner image onto the recording medium and power consumption consumed by conveyance of the recording medium onto which the toner image is to be fixed is computed according to a type of the recording medium, the third power consumption consumed by the exposure unit of the image forming apparatus to expose the photosensitive member of the image forming apparatus to light is computed according to an image to be formed, and a sum of the first to third power consumptions is computed. It is therefore possible to compute power consumption of the image forming apparatus with accuracy.

Further features of the present invention will become apparent from the following description of an exemplary embodiment with reference to the attached drawings.

BRIEF DESCRIPTION OF THE DRAWINGS

FIG. 2 is a view showing a fixing-device power consumption table and a sheet-conveyance power consumption table, which are provided in a printer engine controller of the image forming apparatus;

DESCRIPTION OF THE EMBODIMENTS

The present invention will now be described in detail below with reference to the drawings showing a preferred embodiment thereof.

Figure 1:
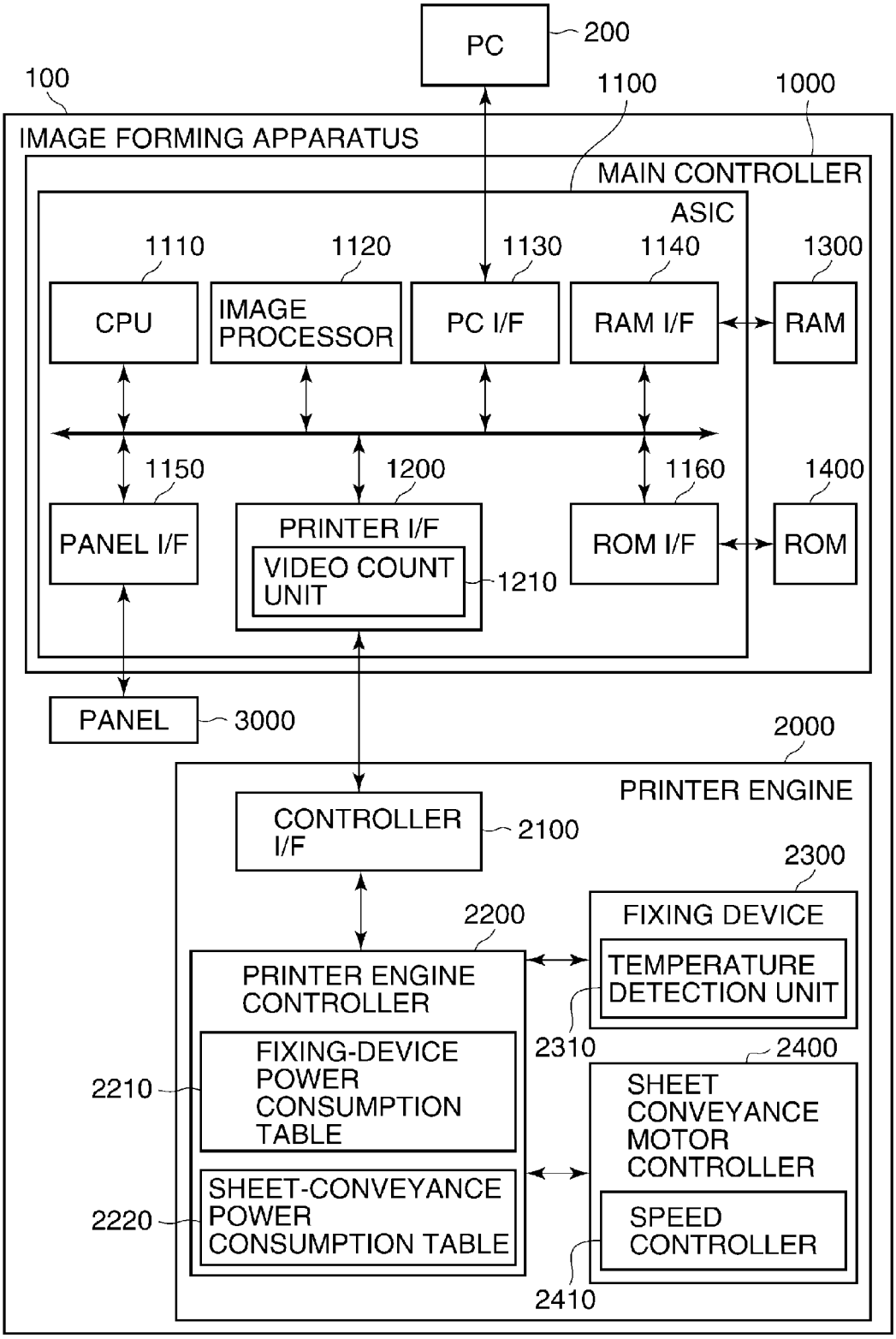
FIG. 1 is a block diagram schematically showing the construction of an image forming apparatus according to one embodiment of this invention.

FIG. 1 schematically shows in block diagram the construction of an image forming apparatus according to one embodiment of this invention.

As shown in FIG. 1, the image forming apparatus 100 includes amain controller 1000 that controls the entire image forming apparatus 100, a printer engine 2000 that forms or prints an image on a recording medium such as a sheet of paper, and a panel 3000 that provides a user interface for displaying information to a user and for being used by a user to operate the image forming apparatus 100.

The main controller 1000 includes an ASIC 1100 that controls the main controller 1000, a RAM 1300 that is a volatile memory having a control program execution area, a work data area, and an output data storage area, and a ROM 1400 that is a nonvolatile memory storing control programs.

The ASIC 1100 includes a CPU 1110 that controls respective parts of the main controller 1000, an image processor 1120 that performs image processing on a print job sent from a PC 200, and a PC interface 1130 that receives the print job from the PC 200. The ASIC 1100 also includes a RAM interface 1140, a panel interface 1150, and a ROM interface 1160 that respectively perform data communication with the RAM 1300, the panel 3000, and the ROM 1400. The ASIC 1100 further includes a printer interface 1200 that transfers image data to the printer engine 2000 and performs control communication with the printer engine 2000. The printer interface 1200 includes a video count unit 1210 that counts a video count value, which will be described later.

The printer engine 2000 includes a controller interface 2100 that performs data communication with the main controller 1000, and a printer engine controller 2200 that controls the printer engine 2000 and has a fixing-device power consumption table 2210 and a sheet-conveyance power consumption table 2220.

The printer engine 2000 also includes a fixing device 2300 that becomes a state capable of fixing a toner image onto a sheet when the actual temperature of the fixing device 2300 is increased to a predetermined temperature. The fixing device 2300 includes a temperature detection unit 2310 that detects an actual temperature of the fixing device 2300.

The printer engine 2000 further includes a sheet conveyance motor controller 2400 that includes a speed controller 2410 for controlling the speed of a sheet conveyance motor (not shown).

FIG. 2 collectively shows the fixing-device power consumption table 2210 and the sheet-conveyance power consumption table 2220, which are provided in the printer engine controller 2200.

The fixing-device power consumption table 2210 shows a relation between sheet type and fixing-device power consumption. The term "fixing-device power consumption" refers to power consumption consumed by the fixing device 2300 to fix an image onto a sheet. The fixing-device power consumption table 2210 includes a "sheet type" field in which there are indicated sheet sizes A3, B4, A4, B5, letter, regal, and postcard that represent sheet types and a "fixing-device power consumption" field in which there are indicated values "PW_F (sheet type)_image type" that represent fixing-device power consumptions corresponding to combinations of sheet types and image types (monochrome image BW or color image CL). For example, a value "PW_F B4_BK" represents a fixing-device power consumption that corresponds to a combination of sheet size B4 and monochrome image BK. In an actual table, concrete numerical values are indicated instead of the values "PW_F (sheet type)_image type".

The sheet-conveyance power consumption table 2220 shows a relation between sheet type and sheet conveyance power consumption (i.e., power consumption consumed by the sheet conveyance motor to convey a sheet when an image is fixed onto the sheet by the fixing device 2300). The sheet-conveyance power consumption table 2220 includes a "sheet type" field in which there are indicated sheet sizes that represent sheet types and a "sheet conveyance power consumption" field in which there are indicated values "PW_C (sheet type)" that represent sheet conveyance power consumptions corresponding to sheet types. For example, a value "PW_C B4" represents a fixing-device power consumption that corresponds to the sheet size B4. In an actual table, concrete numerical values are indicated instead of the values "PW_C (sheet type)".

Figure 3:
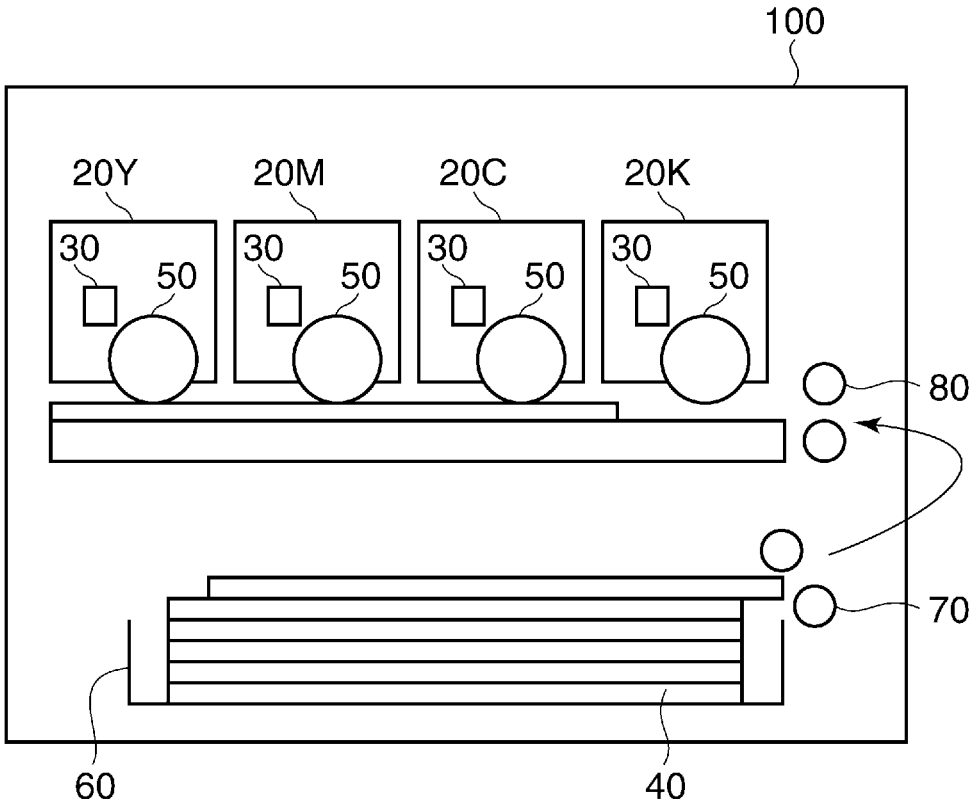
FIG. 3 is a schematic view showing the construction of an essential part of the image forming apparatus.

FIG. 3 schematically shows the construction of an essential part of the image forming apparatus 100.

In FIG. 3, reference numerals 20C, 20M, 20Y, and 20K respectively denote color toner cartridges for cyan, magenta, yellow, and black colors. Each toner cartridge includes a photosensitive member 50, an exposure unit 30 that exposes the photosensitive member 50 to light according to an image to be formed, thereby forming an electrostatic latent image on the photosensitive member 50, a developing device (not shown) that develops the electrostatic latent image to form a toner image on the photosensitive member 50, a cleaner (not shown) that removes residual toner on the photosensitive member 50, and the like.

In the case of color printing, the toner cartridges 20Y, 20M, 20C, and 20K are used. In the case of monochrome printing, the toner cartridge 20K alone is used.

In the image forming apparatus 100, a sheet transfer system that includes conveyance roller pairs 70, 80 is driven by sheet conveyance motors (not shown) under the control of the sheet conveyance motor controller 2410, and sheets 40 are transferred one by one from a sheet cassette 60 to the toner cartridge 20K or to the toner cartridges 20C, 20M, 20Y and 20K. A toner image formed on the photosensitive member 50 is transferred to the sheet 40 and then fixed onto the sheet 40 by the fixing device 2300.

The PC 200 generates and compresses bitmap data (which is image data), and transmits a print job including the compressed bitmap data and additional sheet type information to the image forming apparatus 100.

In a case that the image forming apparatus 100 is implemented by a printer that uses a page description language, the PC 200 generates page description language code data instead of bitmap data, and transmits a print job including the code data to the image forming apparatus 100. The image forming apparatus 100 interprets the code data and generates bitmap data.

In the main controller 1000, the PC interface 1130 receives the compressed bitmap data, and the image processor 1120 decompresses the compressed bitmap data. The bitmap data is comprised of ON pixel data representing pixels on which toner is to be adhered and OFF pixel data representing pixels on which no toner is to be adhered.

The bitmap data is transferred to the printer engine 2000. At that time, the video count unit 1210 adds up the number of pieces of ON pixel data (hereinafter, referred to as the video count value) in the image data. The total number of pixels on the entire A4 sheet is equal to about the product of 5000 and 7000 in the case of 600 dpi. In the case of color image data, the video count unit 1210 adds up video count values in image data for respective CMYK colors.

Figure 4:
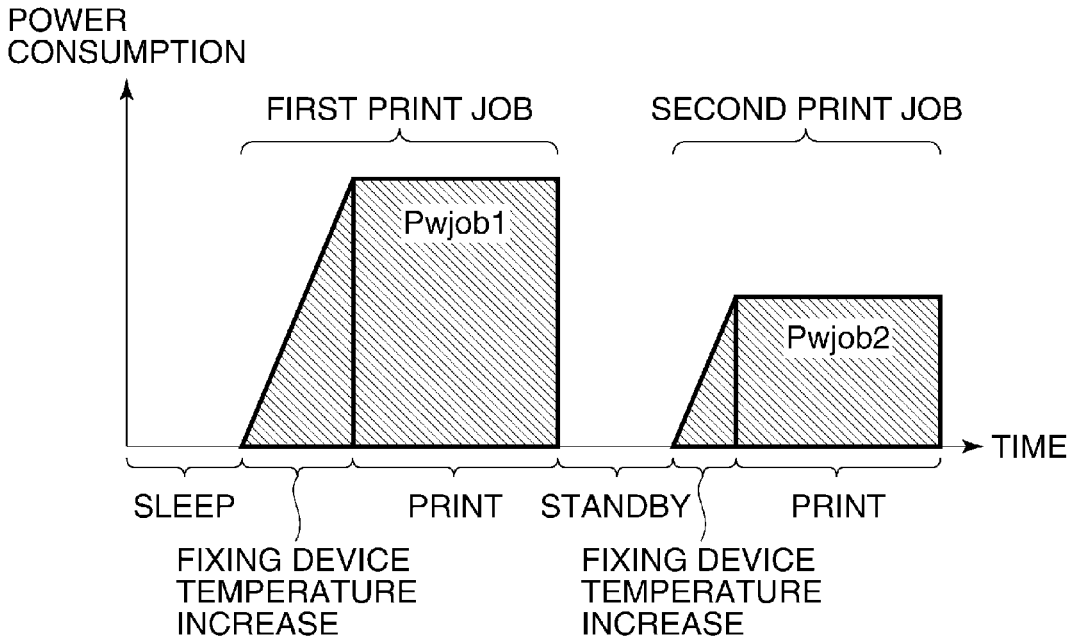
FIG. 4 is view showing a time-dependent change of power consumption consumed by the image forming apparatus to execute print jobs.

FIG. 4 shows a time-dependent change of power consumption consumed by the image forming apparatus 100 to execute print jobs.

In FIG. 4, there is shown an example in which a first print job whose execution is started from a sleep state of the image forming apparatus 100 and a second print job whose execution is started from a standby state of the apparatus 100 are executed in sequence. Elapsed time is shown along the abscissa, and power consumption of the image forming apparatus 100 is shown along the ordinate.

When receiving the first print job, the image forming apparatus 100 wakes up from the sleep state and increases the temperature of the fixing device 2300 to a predetermined temperature where the fixing device 2300 becomes capable of performing a fixing operation, while consuming power. This power consumption, i.e., the power consumption consumed to bring the fixing device 2300 into a state capable of performing the fixing operation (hereinafter, referred to as the first power consumption) is represented by PWpre1. The first power consumption PWpre1 corresponds to the area of a hatched triangular region shown in FIG. 4 in association with the first print job.

When the fixing device 2300 becomes a state capable of performing the fixing operation, the image forming apparatus 100 executes the first print job, while consuming power. This power consumption is represented by PWjob1. During the execution of the first print job, the exposure unit 30 exposes the photosensitive member 50 to light to thereby form an electrostatic latent image on the photosensitive member 50, and the electrostatic latent image is developed into a toner image. On the other hand, a sheet is conveyed from the sheet cassette 60 to the toner cartridge (s) and is further conveyed to the fixing device 2300 where the toner image is fixed onto the sheet. Hereinafter, power consumption including power consumption consumed by the toner image fixing and power consumption consumed by the sheet conveyance will be referred to as the second power consumption, and power consumption consumed by exposure of the photosensitive member 50 to light will be referred to as the third power consumption. The power consumption PWjob1 is represented by the sum of the second and third power consumptions, and corresponds to the area of a hatched rectangular region shown in FIG. 4 in association with the first print job.

When the first print job is complete, the image forming apparatus 100 shifts to a standby state. When receiving the second print job, the image forming apparatus 100 wakes up from the standby state and increases the temperature of the fixing device 2300 to the predetermined temperature, while consuming power. This power consumption (i.e., the first power consumption consumed by the fixing device 2300 to become a state capable of performing the fixing operation) is represented by PWpre2.

Since the fixing device temperature is higher when the image forming apparatus 100 is in the standby state than when the apparatus 100 is in the sleep state, the first power consumption PWpre2 consumed to increase the fixing device temperature from the standby state is smaller than the first power consumption PWpre1 consumed to increase the fixing device temperature from the sleep state.

When the fixing device 2300 becomes a state capable of performing the fixing operation, the image forming apparatus 100 executes the second print job, while consuming power. This power consumption is represented by PWjob2. In the example of FIG. 4, the power consumption PWjob2 consumed to execute the second print job is smaller than the power consumption PWjob1 consumed to execute the first print job.

In the following, a power consumption difference observed between different print jobs will be described. First, a description will be given of a power consumption difference observed when the same print content is printed on sheets of different types. Then, a description will be given of a power consumption difference observed when different print contents are printed on sheets of the same type.

Figure 5A:
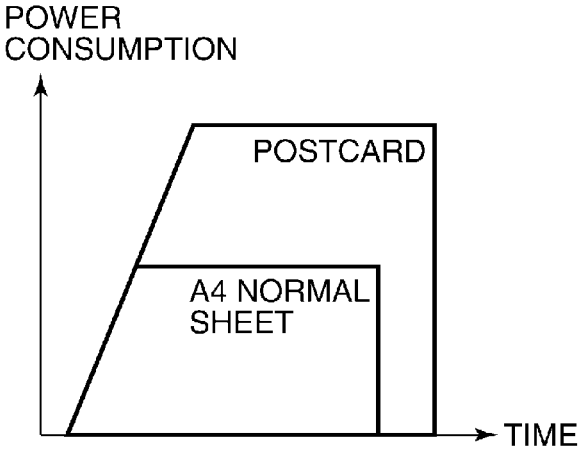
FIG. 5A is a view showing a difference between power consumptions consumed by execution of two print jobs where the same print content is printed on an A4 normal sheet and on a postcard, respectively.
Figure 5B:
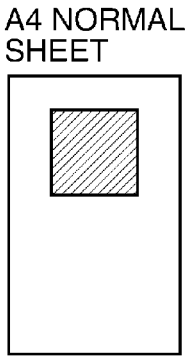
FIGS. 5B and 5C are views schematically showing the print content printed on the A4 normal sheet and on the postcard when the print jobs shown in FIG. 5A are executed.
Figure 5C:
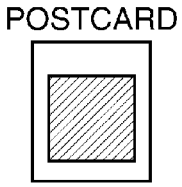
Figure 5D:
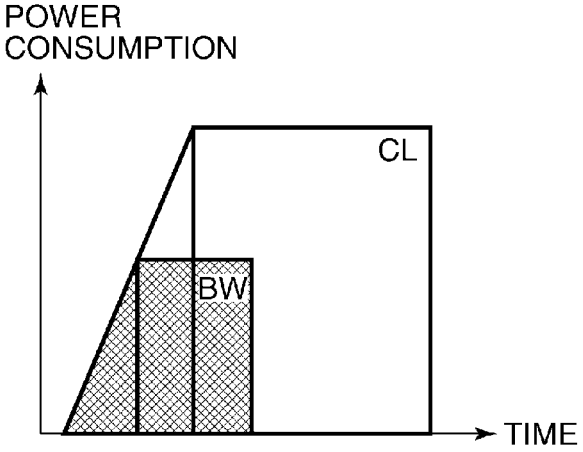
FIG. 5D is a view showing a difference between power consumptions consumed by execution of two print jobs where different print contents are printed on A4 normal sheets.
Figure 5E:
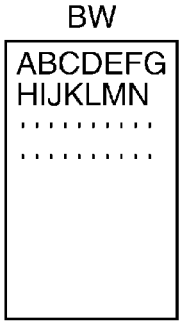
FIGS. 5E and 5F are views schematically showing print contents printed on the respective A4 normal sheets when the print jobs shown in FIG. 5D are executed.
Figure 5F:
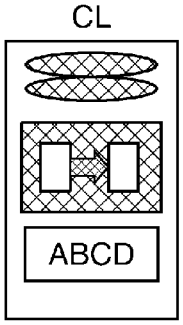

FIG. 5A shows a difference between power consumptions consumed by execution of two print jobs where the same print content is printed on an A4 normal sheet and on a postcard, and FIGS. 5B and 5C show the print content printed on the A4 normal sheet and on the postcard. FIG. 5D shows a difference in power consumptions consumed by execution of two print jobs where different print contents are printed on A4 normal sheets, and FIGS. 5E and 5F show the print contents printed on the respective A4 normal sheets.

In the two print jobs shown for comparison in FIG. 5A, the same print content (which is shown by each of rectangular hatched regions in FIGS. 5B and 5C) is printed on sheets of different types, i.e., on the A4 normal sheet and on the postcard. A predetermined temperature of the fixing device 2300 at which the fixing device 2300 becomes a state capable of performing a fixing operation is higher when an image is fixed to the postcard than when fixed to the A4 normal sheet since the postcard is thicker than the A4 normal sheet. Thus, power consumption consumed to increase the fixing device temperature to the predetermined temperature to bring the fixing device 2300 to a state capable of performing the fixing operation is higher when the image is fixed to the postcard than when fixed to the A4 normal sheet.

The sheet conveyance speed is lower when the postcard thicker than the A4 normal sheet is conveyed than when the A4 normal sheet is conveyed. Accordingly, power consumption for sheet conveyance is larger when the postcard is conveyed than when the A4 normal sheet is conveyed.

As apparent from the foregoing description and from FIG. 5A, power consumption for execution of the print job on the postcard is larger than power consumption for execution of the print job on the A4 normal sheet. In other words, power consumption for execution of a print job varies depending on sheet type, even if print content remains the same.

In the two print jobs shown for comparison in FIG. 5D, different print contents (i.e., a monochrome image denoted by symbol BW in FIG. 5E and a color image denoted by symbol CL in FIG. 5F) are printed on sheets of the same type, i.e., on A4 normal sheets. The predetermined temperature of the fixing device 2300 at which the fixing device 2300 becomes a state capable of performing a fixing operation is higher when the color image CL is fixed than when the monochrome image BW is fixed since a toner amount used for formation of the color image CL is larger than that used for formation of the monochrome image BW. Thus, power consumption consumed to increase the fixing device temperature to the predetermined temperature is higher when the color image CL is formed than when the monochrome image BW is formed.

The number of ON pixels (i.e., video count value) in image data of the same size is larger in the color image CL than in the monochrome image BW. Thus, the third power consumption consumed by exposure of the photosensitive member 50 to light for electrostatic latent image formation and hence power consumption for execution of a print job (i.e., the sum of the first, second, and third power consumptions) are larger in the case of the color image CL than in the case of the monochrome image BW. In other words, the third power consumption and hence the power consumption for execution of a print job vary depending on the print content (the number of ON pixels in image data), even if the sheet type remains the same.

As described above, power consumption for execution of a print job varies depending on print content, especially, the number of ON pixels in image data (video count value). Thus, this embodiment computes the third power consumption based on a video count value counted by the video count unit 1210, thereby eliminating a power consumption computing error from occurring.

Figure 6:
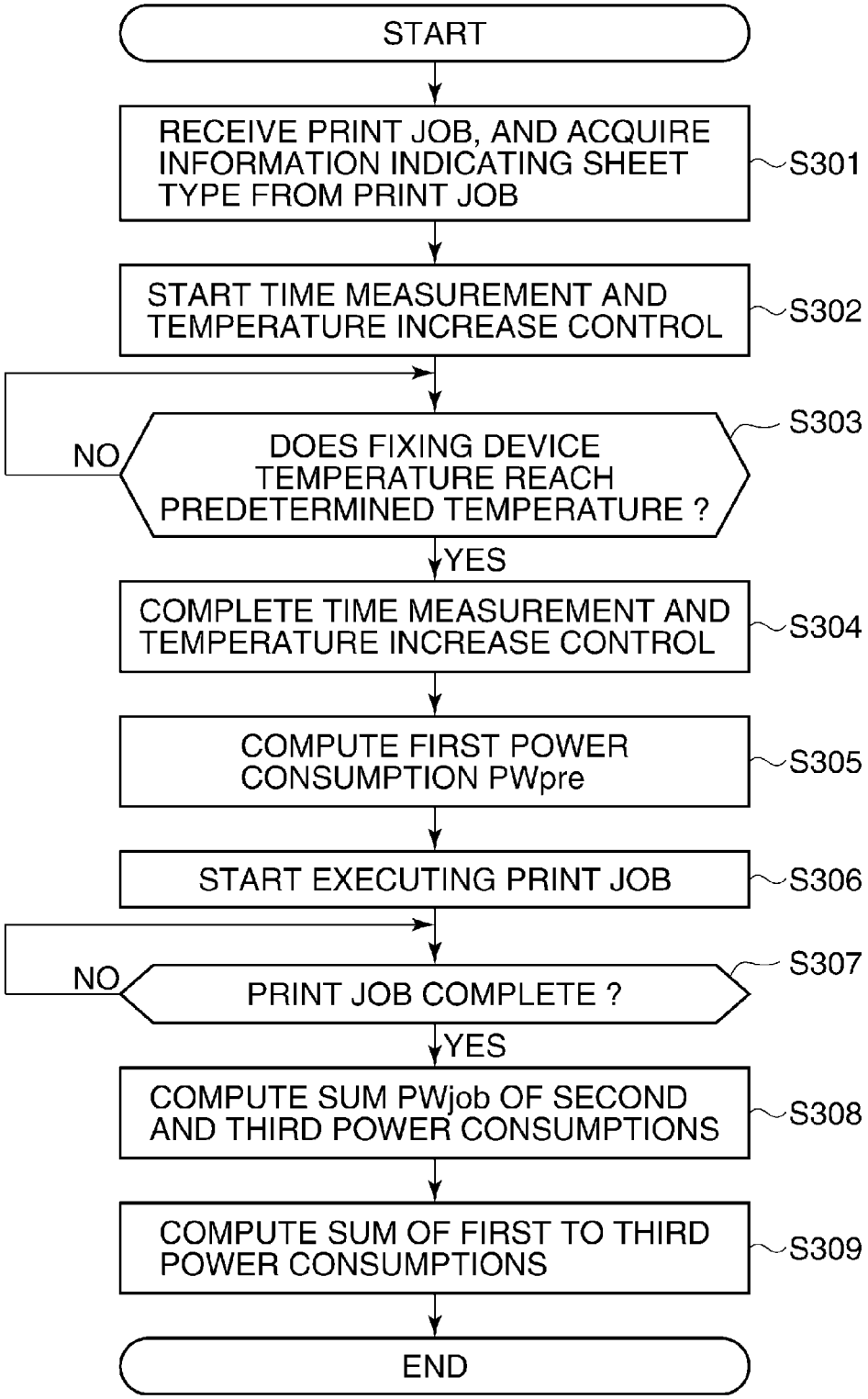
FIG. 6 is a flowchart showing procedures of a power consumption computing process executed by a main controller of the image forming apparatus while the fixing device temperature is increased at a predetermined temperature increase rate.

FIG. 6 shows in flowchart the procedures of a power consumption computing process executed by the controller 1000 while the fixing device temperature is increased at a predetermined temperature increase rate.

A program for the power consumption computing process is read from the ROM 1400 and developed in the RAM 1300 for execution by the main controller 1000.

In the power consumption computing process of FIG. 6, the main controller 1000 of the image forming apparatus 100 receives a print job from the PC 200 through the PC interface 1130, acquires information indicating a sheet type to be used for the print job, and determines from the received print job whether an image type to be formed by the print job is monochrome image or color image (step S301). Next, based on the sheet type and the image type determined in step S301, the main controller 1000 reads from e.g., the ROM 1400 information representing the predetermined temperature of the fixing device 2300, and starts temperature increase control for increasing the temperature of the fixing device 2300 up to the predetermined temperature at a predetermined temperature increase rate. The main controller 1000 also starts a time measurement and notifies the printer engine 2000 through the printer interface 1200 that the main controller has received the print job (S302).

Next, the main controller 1000 determines whether an actual temperature of the fixing device 2300 detected by the temperature detection unit 2310 reaches the predetermined temperature (step S303). If the answer to step S303 is NO, the process returns to step S303. When the actual temperature of the fixing device 2300 reaches the predetermined temperature (i.e., if the answer to step S303 is YES), the main controller 1000 determines that the fixing device 2300 becomes a state capable of performing a fixing operation, and completes the time measurement and the temperature increase control (step S304).

Based on the measured time, a difference between the predetermined temperature and the actual temperature detected for the first time by the temperature detection unit 2310, and the predetermined temperature increase rate, the main controller 1000 (first computing unit) computes the first power consumption PWpre consumed to bring the fixing device 2300 to a state capable of performing the fixing operation (step S305).

Next, the main controller 1000 starts executing the print job (step S306), and determines whether the print job is complete (step S307). If the answer to step S307 is NO, the process returns to step S307.

If the print job is complete (i.e., if the answer to step S307 is YES), the main controller 1000 (second computing unit) decides fixing device power consumption that corresponds to the information representing sheet type acquired in step S301 and the image type determined in step S301, while referring to the fixing-device power consumption table 2210 of FIG. 2, and also decides sheet conveyance power consumption that corresponds to the information representing sheet type acquired in step S301, while referring to the sheet-conveyance power consumption table 2220 of FIG. 2. Then, the main controller 1000 adds together the fixing device power consumption and the sheet conveyance power consumption, thereby computing second power consumption. The main controller 1000 (third computing unit) reads a video count value from the video count unit 1210 in the printer I/F 1200, computes third power consumption consumed by exposure of the photosensitive member 50 to light based on the video count value, and adds together the second and third power consumptions to thereby compute the power consumption PWjob consumed by execution of the print job (step S308).

Next, the controller 1000 (fourth computing unit) computes a sum of the first power consumption PWpre and the second and third power consumptions PWjob (step S309), and completes the present process.

According to the power consumption computing process of FIG. 6, the first power consumption corresponding to sheet type and image type is computed based on the measured time period of temperature increase, the second power consumption is computed by adding together the fixing device power consumption corresponding to sheet type and image type and decided referring to the fixing-device power consumption table 2210 and the sheet conveyance power consumption decided referring to the sheet-conveyance power consumption table 2220, and the third power consumption is computed based on the video count value. The first to third power consumptions are added together, thereby computing power consumption consumed by execution of the print job. Accordingly, the power consumption of the image forming apparatus 100 can be computed with accuracy.

Figure 7:
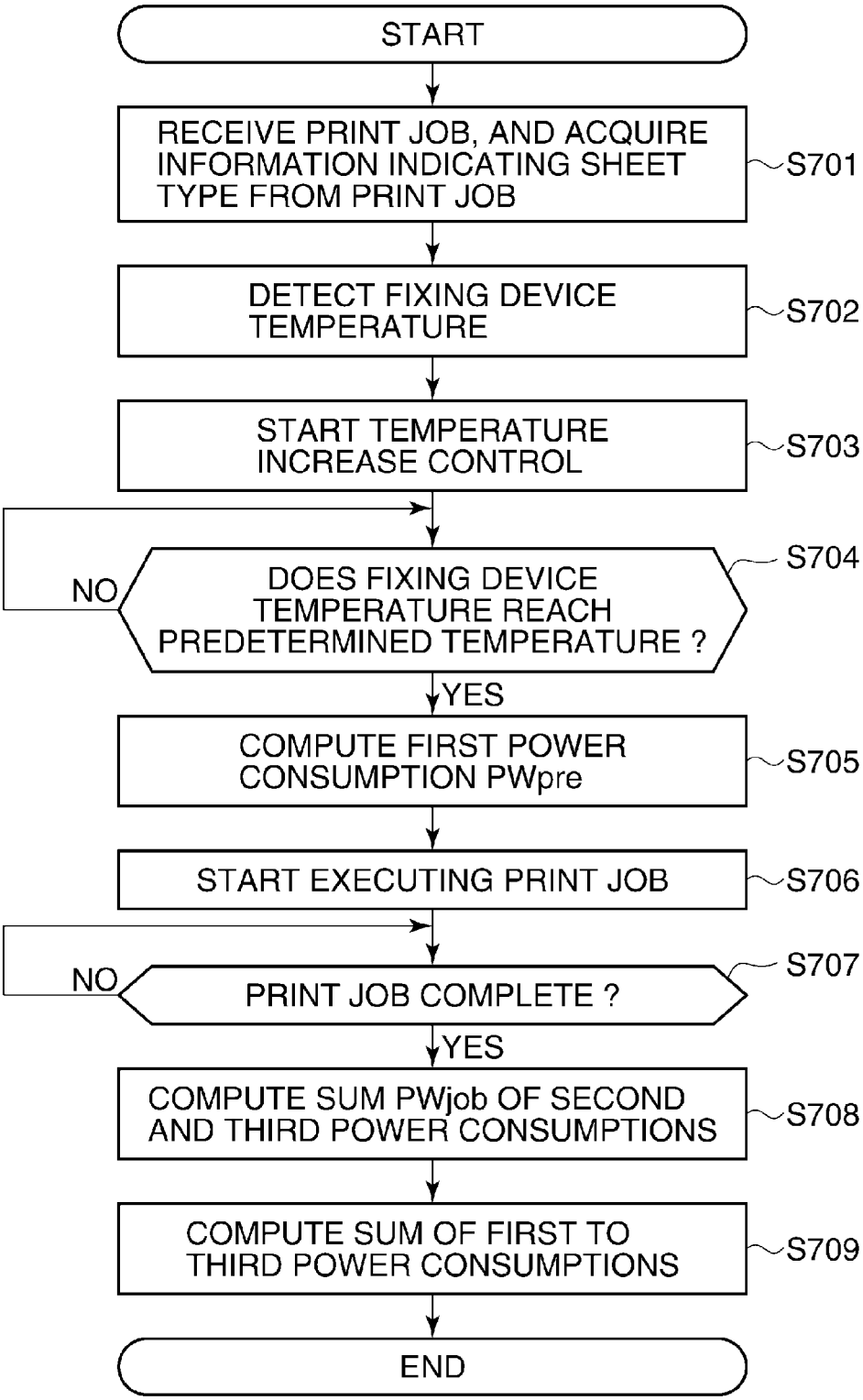
FIG. 7 is a flowchart showing procedures of a power consumption computing process executed by the main controller while the fixing device temperature is increased to a predetermined temperature in a predetermined time period.

FIG. 7 shows in flowchart the procedures of a power consumption computing process executed by the main controller 1000 while the fixing device temperature is increased to a predetermined temperature in a predetermined time period.

A program for the power consumption computing process is read from the ROM 1400 and developed in the RAM 1300 for execution by the main controller 1000.

In the power consumption computing process of FIG. 7, the main controller 1000 of the image forming apparatus 100 receives a print job from the PC 200 through the PC interface 1130, acquires, from the received pint job, information representing a sheet type to be used for the print job, and determines from the print job an image type to be formed by the print job (step S701). Next, the main controller 1000 acquires information representing the predetermined temperature of the fixing device 2300 (corresponding to the sheet type and the image type determined in step S701), acquires information representing an actual temperature of the fixing device 2300 and detected by the temperature detection unit 2310, and notifies the printer engine 2000 that the main controller 1000 has received the print job (step S702).

Based on the information representing the predetermined temperature and the information representing the actual temperature of the fixing device 2300, which are acquired in step S702, the main controller 1000 starts temperature increase control to increase the fixing device temperature to the predetermined temperature in the predetermined time period (step S703).

Next, the main controller 1000 determines whether the actual temperature of the fixing device 2300 reaches the predetermined temperature (step S704). If the answer to step S704 is NO, the process returns to step S704. If the actual temperature of the fixing device 2300 reaches the predetermined temperature (i.e., if the answer to step S704 is YES), the main controller 1000 completes the temperature increase control, and computes power consumption PWpre consumed to bring the fixing device 2300 to a state capable of performing a fixing operation based on the temperature difference between the predetermined temperature and the actual temperature of the fixing device 2300 detected for the first time (step S705).

In steps S706 to S709, the main controller 1000 performs the same processing as that performed in steps S306 to S309 in FIG. 6. Specifically, the main controller 1000 starts executing the print job (step S706), and if the print job is complete (if the answer to step S707 is YES), decides fixing device power consumption and sheet conveyance power consumption, and adds together these power consumptions to thereby compute second power consumption. The main controller 1000 computes third power consumption based on the video count value, adds together the second and third power consumptions to thereby compute power consumption PWjob consumed by the execution of the print job (step S708), and computes the sum of the first power consumption PWpre and the second and third power consumptions PWjob (step S709), whereupon the present process is completed. With the power consumption computing process of FIG. 7, effects similar to those achieved by the power consumption computing process of FIG. 6 can be achieved.

Other Embodiments

Aspects of the present invention can also be realized by a computer of a system or apparatus (or devices such as a CPU or MPU) that reads out and executes a program recorded on a memory device to perform the functions of the above-described embodiment, and by a method, the steps of which are performed by a computer of a system or apparatus by, for example, reading out and executing a program recorded on a memory device to perform the functions of the above-described embodiment. For this purpose, the program is provided to the computer for example via a network or from a recording medium of various types serving as the memory device (e.g., computer-readable medium).

While the present invention has been described with reference to an exemplary embodiment, it is to be understood that the invention is not limited to the disclosed exemplary embodiment. The scope of the following claims is to be accorded the broadest interpretation so as to encompass all such modifications and equivalent structures and functions.

This application claims the benefit of Japanese Patent Application No. 2010-240921, filed Oct. 27, 2010, which is hereby incorporated by reference herein in its entirety.

What is claimed is:

1. An image forming apparatus having a photosensitive member, an exposure unit that exposes the photosensitive member to light according to an image to be formed to thereby form an electrostatic latent image on the photosensitive member, and a fixing device that fixes onto a recording medium a toner image formed on the photosensitive member by developing the electrostatic latent image and transferred from the photosensitive member to the recording medium, comprising:

a first computing unit configured to compute first power consumption consumed by the fixing device until the fixing device becomes a state capable of fixing the toner image onto the recording medium;

a second computing unit configured to compute, according to at least a type of the recording medium, second power consumption that includes power consumption consumed by the fixing device to fix the toner image onto the recording medium and power consumption consumed to convey the recording medium onto which the toner image is to be fixed;

a third computing unit configured to compute, according to the image to be formed, third power consumption consumed by the exposure unit to expose the photosensitive member to light; and a fourth computing unit configured to compute a sum of the first power consumption, the second power consumption, and the third power consumption, wherein the fourth computing unit is configured to compute the sum of the first power consumption, the second power consumption, and the third power consumption after completion of a print job performed using the first power consumption, the second power consumption, and the third power consumption.

2. The image forming apparatus according to claim 1, wherein said first computing unit computes the first power consumption according to a time period required for the fixing device to become the state capable of fixing the toner image onto the recording medium.

3. The image forming apparatus according to claim 1, wherein the fixing device reaches a state capable of fixing the toner image onto the recording medium when an actual temperature of the fixing device is increased to a predetermined temperature, and said first computing unit computes the first power consumption based on a temperature difference between the actual temperature of the fixing device and the predetermined temperature in order to bring the fixing device to a state capable of fixing the toner image.

4. The image forming apparatus according to claim 1, wherein said second computing unit computes the second power consumption according to at least the type of the recording medium by using a table indicating a relation at least between recording medium type and fixing-device power consumption and a table indicating a relation between the recording medium type and recording medium conveyance power consumption.

5. The image forming apparatus according to claim 1, wherein said third computing unit computes the third power consumption based on a total number of pixels, on which toner is to be adhered, in the image to be formed.

6. The image forming apparatus according to claim 1, wherein the second computing unit and the third computing unit are configured to compute the second power consumption and the third power consumption, respectively, after completion of the print job.

7. The image forming apparatus according to claim 6, wherein the first computing unit is configured to compute the first power consumption before completion of the print job.

8. A control method for an image forming apparatus having a photosensitive member, an exposure unit that exposes the photosensitive member to light according to an image to be formed to thereby form an electrostatic latent image on the photosensitive member, and a fixing device that fixes onto a recording medium a toner image formed on the photosensitive member by developing the electrostatic latent image and transferred from the photosensitive member to the recording medium, comprising:

a first computing step of computing first power consumption consumed by the fixing device until the fixing device becomes a state capable of fixing the toner image onto the recording medium;

a second computing step of computing, according to at least a type of the recording medium, second power consumption that includes power consumption consumed by the fixing device to fix the toner image onto the recording medium and power consumption consumed to convey the recording medium onto which the toner image is to be fixed;

a third computing step of computing, according to the image to be formed, third power consumption consumed by the exposure unit to expose the photosensitive member to light; and a fourth computing step of computing a sum of the first power consumption, the second power consumption, and the third power consumption, wherein the fourth computing step occurs after completion of a print job performed using the first power consumption, the second power consumption, and the third power consumption.

9. A non-transitory computer-readable storage medium storing a program for causing a computer to execute a control method for an image forming apparatus having a photosensitive member, an exposure unit that exposes the photosensitive member to light according to an image to be formed to thereby form an electrostatic latent image on the photosensitive member, and a fixing device that fixes onto a recording medium a toner image formed on the photosensitive member by developing the electrostatic latent image and transferred from the photosensitive member to the recording medium, comprising:

a first computing step of computing first power consumption consumed by the fixing device until the fixing device becomes a state capable of fixing the toner image onto the recording medium;

a second computing step of computing, according to at least a type of the recording medium, second power consumption that includes power consumption consumed by the fixing device to fix the toner image onto the recording medium and power consumption consumed to convey the recording medium onto which the toner image is to be fixed;

a third computing step of computing, according to the image to be formed, third power consumption consumed by the exposure unit to expose the photosensitive member to light; and a fourth computing step of computing a sum of the first power consumption, the second power consumption, and the third power consumption, wherein the fourth computing step occurs after completion of a print job performed using the first power consumption, the second power consumption, and the third power consumption.

* * * * *